US006968125B1

(12) United States Patent
Garber

(10) Patent No.: US 6,968,125 B1
(45) Date of Patent: Nov. 22, 2005

(54) SUSPENDABLE INDUSTRIAL ELECTRICAL LIQUID HEATER

(76) Inventor: Robert G. Garber, 485 S. 12th St., San Jose, CA (US) 95112

( * ) Notice: Subject to any disclaimer, the term of this patent is extended or adjusted under 35 U.S.C. 154(b) by 0 days.

(21) Appl. No.: 10/903,744

(22) Filed: Jul. 31, 2004

(51) Int. Cl.[7] ..... F24H 1/10
(52) U.S. Cl. ..... 392/492
(58) Field of Search ..... 219/213; 392/485–493, 392/441–445, 449, 454, 464

(56) References Cited

U.S. PATENT DOCUMENTS

| | | | | | |
|---|---|---|---|---|---|
| 2,445,115 | A | * | 7/1948 | Hanrahan | 165/141 |
| 2,775,683 | A | * | 12/1956 | Kleist | 392/398 |
| 3,835,294 | A | * | 9/1974 | Krohn et al. | 392/484 |
| 4,465,922 | A | * | 8/1984 | Kolibas | 392/484 |
| 4,567,350 | A | * | 1/1986 | Todd Jr. | 392/486 |
| 4,723,065 | A | * | 2/1988 | Meyer | 219/205 |
| 5,265,318 | A | * | 11/1993 | Shero | 29/447 |
| 6,393,212 | B1 | * | 5/2002 | Hutchinson | 392/491 |
| 6,701,069 | B1 | * | 3/2004 | Cezayirli et al. | 392/490 |

* cited by examiner

*Primary Examiner*—Robin O. Evans
*Assistant Examiner*—Vinod Patel

(57) ABSTRACT

An electric heater for industrial liquids comprises a plastic flat box that contains a stainless steel pressure vessel holding a number of parallel electrical heating rods. These heating rods are interlaced with shorter "I" shaped Teflon rods which generates a tube-like space around the heating rods. Spiral grooves in the symmetrical concave faces of the Teflon rods promote a spiraling turbulent flow. The general liquid flow from the liquid inlet meanders around the parallel heating rods for optimal heat transfer. The heater can be mounted horizontally or vertically on the side of a lab bench or a vessel for floor space conservation. The flow speed of the liquid, its specific heat, the number of heating elements with their individual power rating determine the heating profile of liquid temperature versus cumulative length of the flow path which is important to prevent the liquid from reaching the boiling point. This arrangement allows for design flexibility and scalability in heating capacities. The pressure vessel, the wet space, has a smooth interior layout for easy Teflon spray coating to make it suitable for heating aggressive etching liquids.

7 Claims, 5 Drawing Sheets

SUSPENDABLE INDUSTRIAL ELECTRICAL LIQUID HEATER

BACKGROUND

1. Field of the Invention

The invention relates to industrial electrical heaters of liquids, especially for pressurized rinsing and etching liquids.

2. Prior Art

Electrical heaters for liquids have been around for a long time. In certain industries (chemical, pharmaceutical, semiconductors, plating) there is a need to heat process liquids for high quality cleaning and etching of materials. For uniformity and quality control these liquids have to meet high purity standards and tight specifications concerning temperature, output pressure, pressure drop in the heater etc. While such equipment is available, there is still a need for minimum footprint, high reliability and flexibility in such equipment.

SUMMARY OF THE INVENTION

The present invention concerns a new electrical heater for liquids, which can be attached off-the-floor to a lab bench or a vessel. The liquid to be heated enters a stainless steel enclosure holding a parallel plurality of heating rods interlaced with "I"shared TEFLON (PTFE) rods, which creates a tube-like space around the heating rods. Spiral grooves in the sides of the Teflon rods facing the heating rods cause the liquid to swirl turbulently around the heating rods for optimal heat transfer. The liquid meanders along the heating rods from the inlet to the outlet of the enclosure which is surrounded by a plastic box. The flow speed of the liquid, its specific heat the number of heating elements with their individual power rating determine the heating profile of liquid temperature versus cumulative length of the flow path which is important to prevent the liquid from reaching the boiling point. This arrangement allows for design flexibility and scalability in heating capacities.

DESCRIPTION OF THE PREFERRED EMBODIMENT

In the semiconductor, plating, chemical and pharmaceutical industries there is a need to heat liquids for mixing, diluting, rinsing, etching etc. of other liquid or solid materials. In production areas such as in a semiconductor wafer fab, floors pace is of premium value due to the high clean room cost including the high cost of air purification. For this reason it is desirable to minimize the footprint of any equipment or attach it off-the-floor to the side of a lab bench or even a process vessel. The present invention describes such an electric heater, in this case for heating de-ionized water at a pressure up to 3.5 bar (50 psi) for rinsing semiconductor wafers. With proper inert coating of the "wet area" parts of the invention. e.g. by TEFLON, corrosive chemicals like etching solutions can be accommodated.

Figure 1:
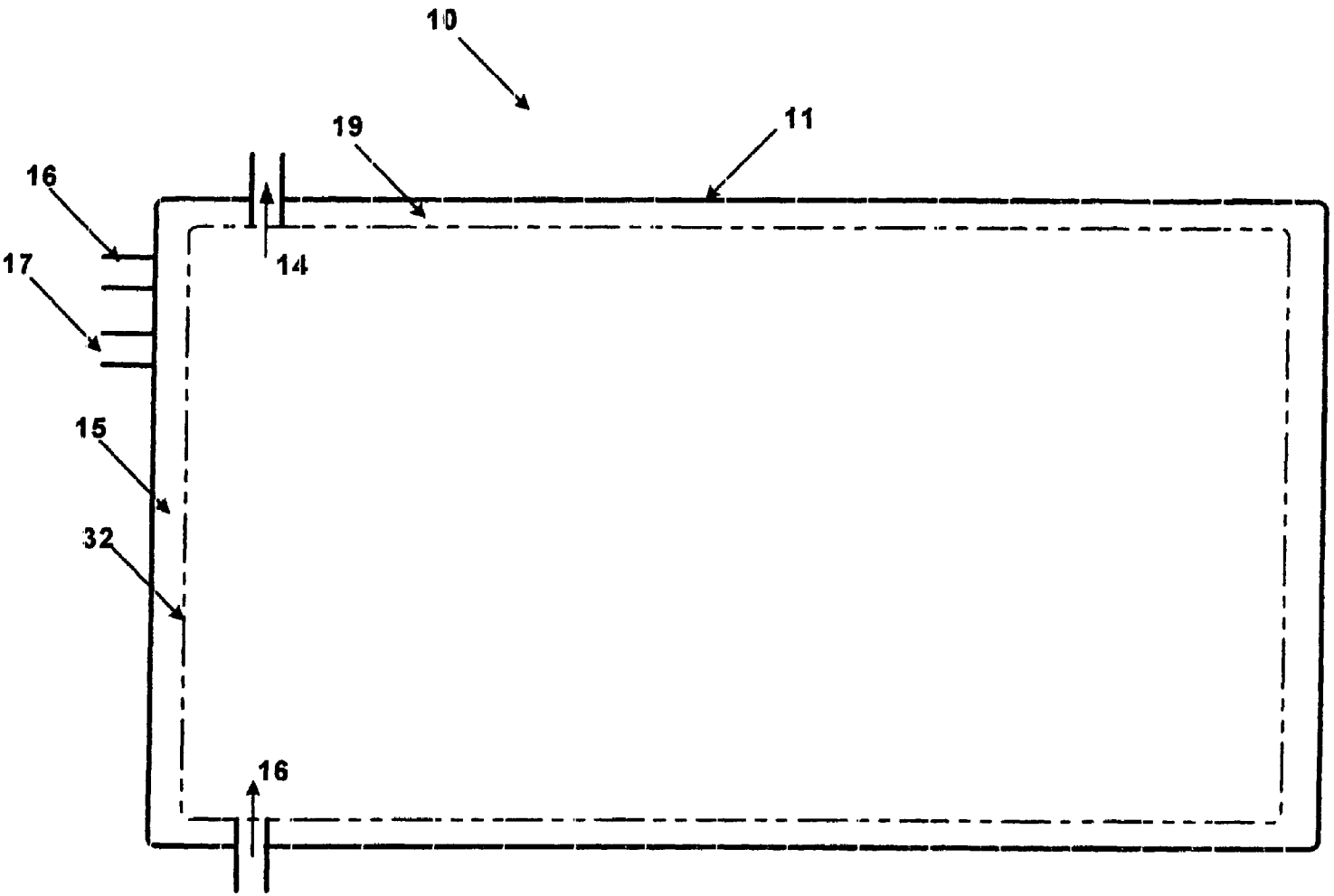
FIG. 1 shows a cross-section of the heater housing.
Figure 2:
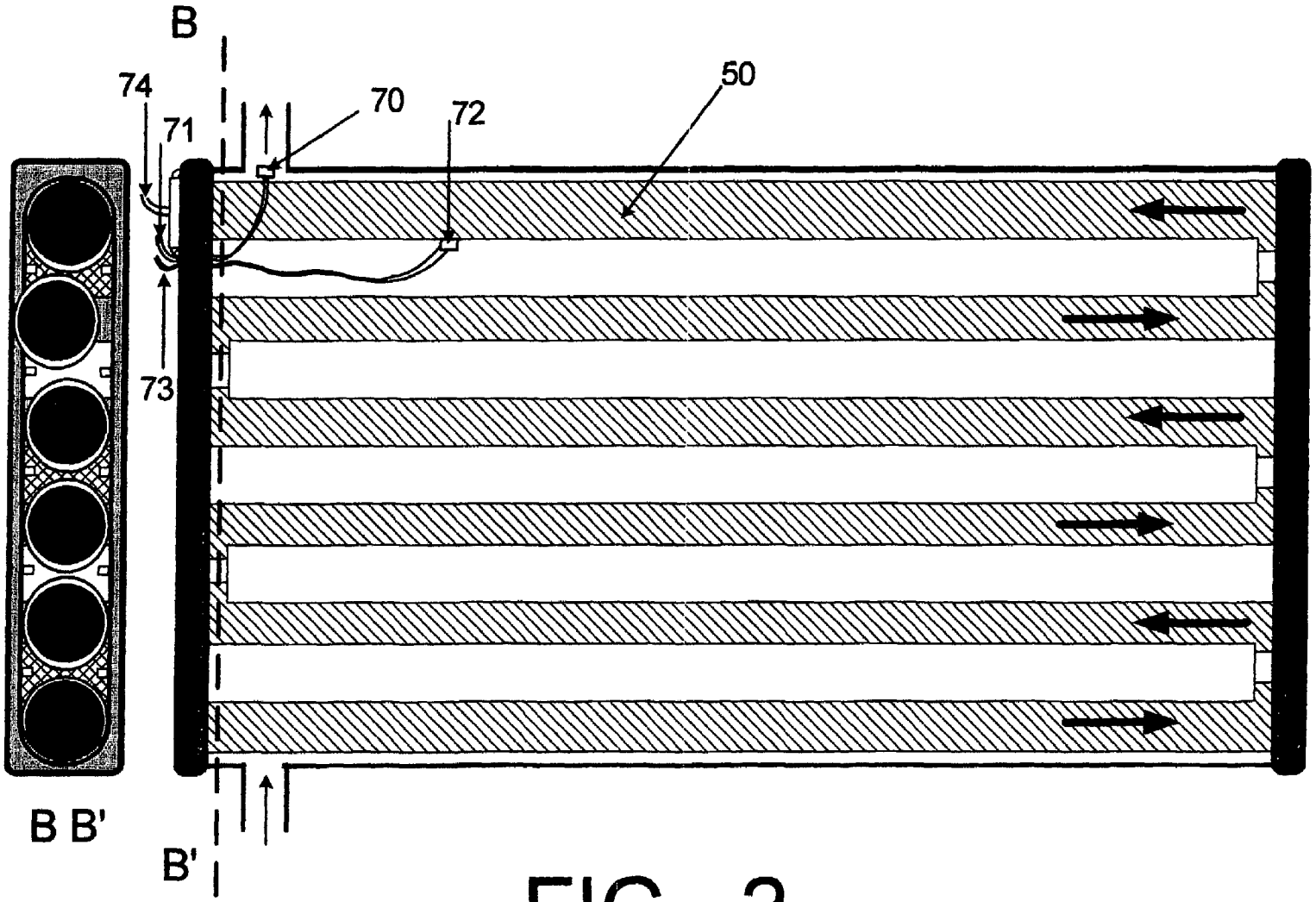
FIG. 2 depicts a cross-section of the heater vessel.
Figure 3:
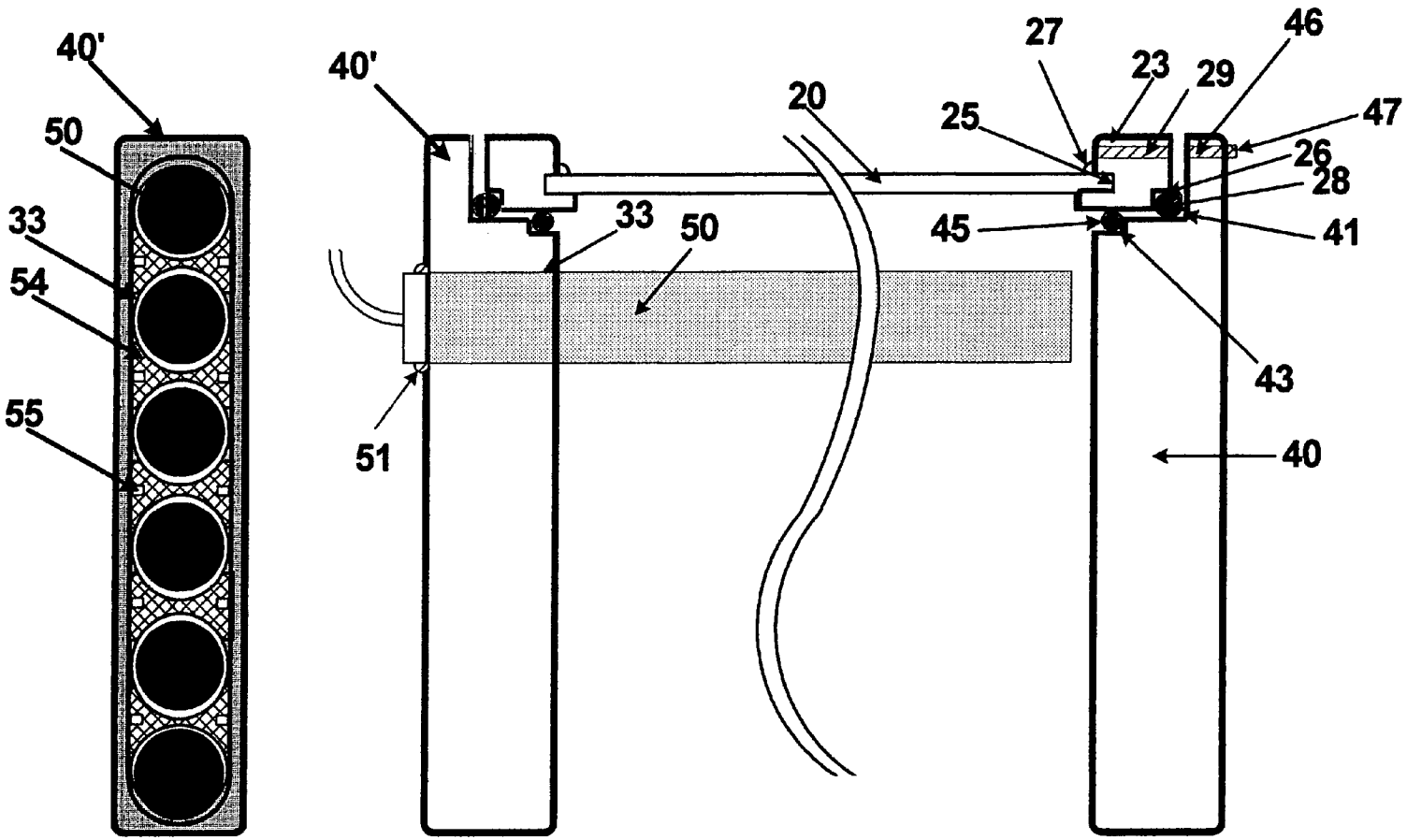
FIG. 3 illustrates a detail of the end cap-vessel interface.

FIG. 1 shows a cross-section of the housing 10 which comprises a plastic box 11, preferably made out of polypropylene, with a liquid inlet 12 at one side, a liquid outlet 14 at the other and flanges 16 and 17 for electrical and thermocouple connections, respectively. The box 11 contains a pressure vessel assembly 19 for the wet space, leak-proof to 3.5 bar (50 psi) comprising vessel 20 as shown in FIG. 2. The periphery of vessel 20 is formed by two opposing, mirror-symmetrical stainless steel sheet metal sections, each with an cross-section of an elongated "U". The two sections are welded together to create a flat cylinder with semicircular edges (a "double U"cross-section). Vessel 20 is closed off at one end by end cap 40 and at the electrical connection end by end cap 40'. FIG. 3 shows the details of the connection for end cap 40 with end cap 40' being basically mirror-symmetrical. In order to prevent buckling of vessel 20 under a pressure of 3.5 bar (50 psi) around the ends vessel 20 butts into recess 25 of a first collar flange 23 which is welded to vessel 20 at peripheral seam 27. Collar flange 23 also carries a recess 26 for O-ring 28 as well as a number of peripheral threaded screw holes 29. The description follows end cap 40 with end cap 40' being basically mirror-symmetrical. It has an elongated peripheral "double-U" shaped recesses 41 for receiving collar flange 23 and O-ring 28. Recess 41 carries smaller diameter recess 43 for receiving O-ring 45. Rectangular end cap 40 has a peripheral row of holes 46 for screws 47. These screws 47 are engaging mating threaded holes 29 in collar flange 23 to affix end cap 40 leak-proof to vessel 20 when o-ring 28 is compressed axially and radially and O-ring 45 is compressed radially. End cap 40' attached to collar flange 23' additionally has a row of holes 33 for receiving heating rods 50 with a metal encasing closed at one end and with electrical connections at the other end. The rods 50 are circumferentially welded within holes 33 of end cap 40', their only support, at their neck near the electrical connections, creating welding seams 51 as depicted in FIG. 3. These connections extend individually into air space 15 of box 11 and via flange 16 to the outside. Rectangular end cans 40 and 40' secure the location of vessel 20 flush within box 11, while insulating spacers (not shown) between vessel 20 and the walls of box 11 prevent sidewise movement of vessel 20 within box 11.

Figure 4:
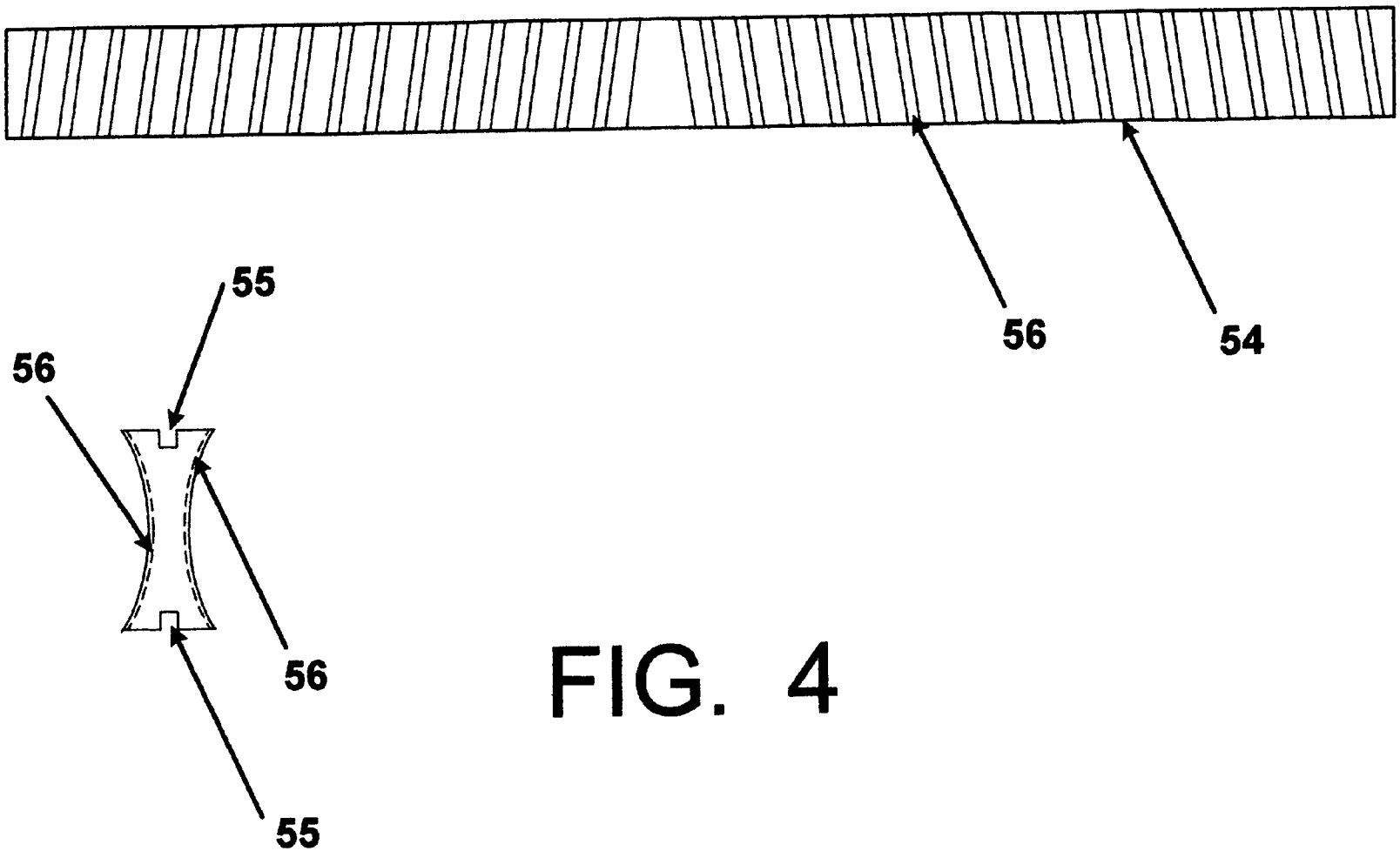
FIG. 4 shows a side view of a Teflon rod with spiral grooves.

The heating rods 50, supported by end can 40', largely determine the length of vessel 20 and thus of box 11. The width of this box is related the small diameter of the rods 40, which is about 13 mm. The height of the box 11 is given by the number of parallel heating rods 50 which are stacked up on too of each other to form a meander path for the liquid to be heated. The heating rods 50 are interlaced with slightly shorter TEFLON rods 54 with lengthwise grooves 55 in the top and bottom flat surfaces. TEFLON rods 54 are held in place by the grooves 55 engaging alignment protrusions 24 welded to the inside of vessel 20. Rods 54 form a tube-shaped hollow space for liquid flow with and around heating rods 50. A swirling turbulent flow around heating rods 50 is Promoted by spiral grooves 56 in the curved "I" faces of rods 44, as shown in FIG. 4, for a clockwise CW, counter-clockwise CCW or even in a part CW part CCW flow or multiple combinations thereof, tailored to the liquid to be heated. Spiraling the liquid flow allows for maximum turbulent heat transfer from the entire surface area of a rod 50 to the liquid and for maximum liquid path length. Turbulent flow is the most effective way of heat transfer, implying a Reynold's number above 2000. The fast spiral flow around the heater elements promotes the effect of this physical principle. The transition of the liquid flow at the end point of a lower rod 50 to a next higher rod is accomplished by the "flow-around" window created by the shorter TEFLON rod 54 being located flush to the opposite end cap. These flow-around windows are alternated between rods 50. The liquid flow starts around the lowest rod 50 of the stack in a first left-to-right direction then in the opposite right-to-left second direction around the next higher rod and meanders upwards in this fashion to the top rod and from there to the liquid outlet 14. This arrangement assumes the long side of box 11 to be mounted horizontally. A vertical mounting is also possible with the electrical connections extending from the ton for moisture reliability reasons. In flowing through the spirals and meanders the liquid has to be prevented from reaching the boiling point. This can be achieved by adjusting the profile temperature vs. fluid path length by placing heating rods 50 of different power ratings un the stack e.g. by placing say 3 kW rods close to the inlet and say ½ kW rods close to the outlet. Other ways for preventing boiling are varying the supply voltage and/or the flow rate of the liquid. As seen in FIG. 2 a thermocouple 70 is monitoring the outlet liquid temperature and a thermocouple 72 monitors the temperature of the last-in-line heating rod 50. If that temperature is too high it indicates that no liquid is covering the respective heating rod that the heating rods should be shut off. The wires 71 and 73 from thermocouples 70 and 72, respectively are brought out via flange 17 to their circuitry, and the electrical connections 74 of heating rods 50 are brought out to a power supply via flange 16.

Figure 5:
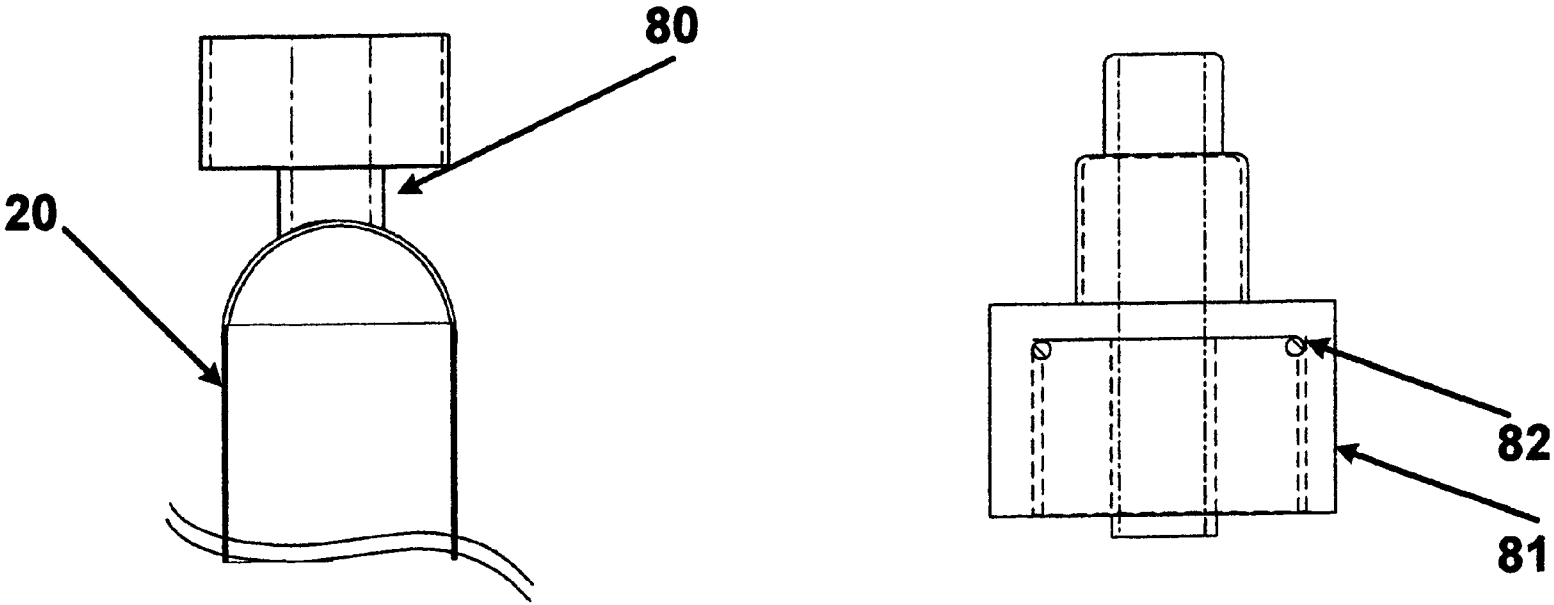
FIG. 5 illustrates the inlet/outlet flange connection.

FIG. 5 shows the inlet/outlet flange connection for vessel 20. The stainless steel flange 80 comprises a ½" tube with a male thread welded to the semi-circular portion of vessel 20 close to end cap 40'. Its mating part is a plastic female receptacle flange 81, made out of TEFLON that is screwed leak-proof to the flange 80 by means of O-ring 82. The receptacle flange can be customized: in this version it carries a male thread and a female thread for versatility in piping. The shape of vessel 20 the arrangement of the heating rods 50 within end can 40' and the input/output flanges 80 provide a smooth and un-obstructed interior of vessel assembly 19 for Teflon-spray coating of the wet space for protection against corrosion by aggressive liquids to be heated, e.g. in the semiconductor industry.

What is claimed is:

1. An electrical heater for industrial liquids with a vertically flat structure for off-the-floor placement, comprising a) a housing with a liquid inlet, a liquid outlet, and a flange for electrical power connections;

b) a parallel plurality of electrical heating rods c) a metal enclosure for the heating rods as a wet space, located within the housing;

d) means for closing the enclosure at a first end;

e) means for closing the enclosure at a second end with the heating rods fastened leak-proof for separating the electrical connections within the housing from the wet space; and f) means for providing spacing between and meandering turbulent flow around the heating rods.

2. An electric heater for industrial liquids with a vertically flat structure for off-the-floor placement, comprising a) a vertically flat box-shaped horizontally elongated plastic housing with a liquid inlet, a liquid outlet and a flange for electrical connections;

b) a parallel plurality of commercial electrical heating rods in a metal, tube-like encasing, closed at a first end and with electrical connections at a second end;

c) a flat sheet metal enclosure comprising a top plate and a bottom plate connected by end pieces having a semi-circular cross-section, for receiving the heating rods and for defining a peripheral chamber for the liquid to be heated, and having a flanges for liquid inlet and a flange for liquid outlet;

d) a first end cap with recesses for the heating rods and with a circumferential recess for a leak-proof fitting of the enclosure and having outer dimensions to secure its position within the housing;

e) a second end cap with holes for the heating rods to bring the electrical connections out into housing and with a circumferential recess for a leak-proof fitting of the enclosures and to the outside having outer dimensions to secure its position within the housing and separating the wet space within from the dry space, containing the electrical connections, within the housing;

f) a plurality of TEFLON (PTFE) rods of I-shaped cross-sections to space apart the heating rods forming a tube-like space around them, with a length shorter than that of the heating rods, and having spiral grooves for liquid flow over a surface of the heating rods and alternately aligned to the first end cap and to the second end cap to support meandering flow up the stack, the Teflon rods also having grooves at the top and the bottom to engage the protrusions on the inside of the sheet metal enclosure for securing their positions within the enclosure.

3. The electrical heater of claim 2, wherein the sheet metal enclosure comprises two halves of enclosures, each having a "U" shaped cross-section, welded together to form a flat cylinder with semi-circular sides, and having a collar flange, with threaded holes, close to each end for receiving fastening screws from the first and the second end cap, and with recesses for O-rings for leak-proof attachment within the circumferential recesses of the end caps.

4. The electrical heater of claim 2, wherein

The sheet metal enclosure carries internal protrusions and wherein the Teflon rods carry top and bottom grooves to engage the protrusions to secure the Teflon rods in place within the enclosure.

5. The electrical heater of claim 2, wherein the housing comprises a flange for a first thermocouple, for monitoring the outlet temperature for being within specs, and for a second thermocouple for monitoring the temperature of the last-in-line heating rod for sufficient liquid level.

6. The electrical heater of claim 2, wherein identical inlet and outlet flanges of the stainless steel vessel each comprise a stainless steel pipe welded symmetrically to the semi-circular portions of the vessel close to the collar flanges at the beginning and the end of the liquid flow path, carrying a male thread and mating with a female thread of a plastic flange carrying a male thread and a female thread for versatile customization to fit connecting piping.

7. A method to implement an efficient electrical industrial liquid heater without floor space requirements, comprising the steps of a ) providing a heater box with a liquid inflow, a liquid outflow, a flange for electrical power connections;

b ) providing a parallel plurality of electrical heating rods with metal encasings;

c ) providing a sheet metal enclosure comprising a top and a bottom plate connected by semi-circular end pieces along the longer dimension for receiving the heating rods and having a liquid inlet and a liquid outlet;

d) providing for a first end cap with a circumferential recess and providing an O-ring for a leak-proof fitting with the enclosure, the first end cap having outer dimensions to secure its position within the housing;

e) providing a second end cap with holes for the heating rods to bring the electrical connections out into housing and with a circumferential recess and providing an O-ring for a leak-proof fitting with the enclosure, the second end cap having outer dimensions to secure its position within the housing and separating the wet space within from the dry space, containing the electrical connections, within the housing f) providing a plurality of TEFLON (PTFE) of I-shaped cross-sections to form a tube-like space around the heating rods, having an "I" shaped cross-section with spiral grooves on the curved surfaces, for liquid flow over the heating rods and being shorter than the heating rods to form flow-through windows by alternatingly placing a rod flush to the first end cap and the next rod flush to the second end cap to cause a meandering flow along the plurality of the heating rods, the Teflon rods also having grooves at the top and the bottom to engage the protrusions on the inside of the sheet metal enclosure for securing their positions within the enclosure;

g) welding the heating rods leak-proof to the second flange such that the electrical connections of the heating rods can be brought via the dry space between the enclosure and the plastic via a flange to the outside for electric service.

* * * * *